United States Patent [19]

Ottenstein

[11] Patent Number: 4,999,547

[45] Date of Patent: Mar. 12, 1991

[54] BALLAST FOR HIGH PRESSURE SODIUM LAMPS HAVING CONSTANT LINE AND LAMP WATTAGE

[75] Inventor: Sidney A. Ottenstein, Spring, Tex.

[73] Assignee: Innovative Controls, Incorporated, Houston, Tex.

[21] Appl. No.: 911,526

[22] Filed: Sep. 25, 1986

[51] Int. Cl.[5] ..... H05B 41/38

[52] U.S. Cl. ..... 315/307; 315/158; 315/224; 315/287; 315/308; 315/DIG. 7

[58] Field of Search ..... 315/307, 308, DIG. 2, 315/DIG. 7, 199, 158, 224, 287

[56] References Cited

U.S. PATENT DOCUMENTS

| | | | |
|---|---|---|---|
| Re. 29,498 | 12/1977 | Meiattini | 195/103.5 |
| Re. 30,296 | 6/1980 | Kirby | 307/252 |
| 3,222,572 | 12/1965 | Powell | 315/151 |
| 3,247,422 | 4/1966 | Schultz | 315/206 |
| 3,249,805 | 5/1966 | McCabe | 315/199 |
| 3,259,797 | 7/1966 | Heine | 315/174 |
| 3,265,930 | 8/1966 | Powell | 315/209 |
| 3,309,567 | 3/1967 | Flieder | 315/176 |
| 3,482,142 | 12/1969 | Cluett | 315/105 |
| 3,486,070 | 12/1969 | Engel | 315/225 |
| 3,500,128 | 3/1970 | Liepins | 315/278 |
| 3,505,562 | 4/1970 | Engel | 315/206 |
| 3,541,421 | 11/1970 | Buchman | 320/1 |
| 3,579,026 | 5/1971 | Paget | 315/99 |
| 3,582,708 | 6/1971 | Snyder | 315/91 |
| 3,590,316 | 6/1971 | Engel | 315/209 |
| 3,619,713 | 11/1971 | Biega | 315/105 |
| 3,659,146 | 4/1972 | Munson | 315/92 |
| 3,681,654 | 8/1972 | Quinn | 315/151 |
| 3,689,827 | 9/1972 | Quinn | 315/308 |
| 3,753,071 | 8/1973 | Engel | 315/2 |
| 3,754,160 | 8/1973 | Jensen | 315/97 |
| 3,771,068 | 11/1973 | Paget | 333/20 |
| 3,870,943 | 3/1975 | Weischedel | 321/2 |
| 3,873,882 | 3/1975 | Gershen | 315/92 |
| 3,875,459 | 4/1975 | Remery | 315/205 |
| 3,876,855 | 4/1975 | Hirasawa | 219/131 |
| 3,882,354 | 5/1975 | May | 315/101 |
| 3,886,045 | 5/1975 | Meiattini | 195/103.5 |
| 3,890,537 | 6/1975 | Park | 315/208 |
| 3,894,265 | 7/1975 | Holmes et al. | 315/194 |
| 3,906,302 | 9/1975 | Wigjboom | 315/209 |
| 3,921,035 | 11/1975 | Holmes | 315/307 |
| 3,927,348 | 12/1975 | Zawakski | 315/88 |
| 3,927,349 | 12/1975 | Suhren | 315/205 |
| 3,931,543 | 1/1976 | Nuckolls | 315/177 |
| 3,944,876 | 3/1976 | Helmuth | 315/205 |
| 3,967,159 | 6/1976 | Dendy | 315/247 |
| 3,969,652 | 7/1976 | Herzog | 315/224 |
| 3,989,976 | 11/1976 | Tabor | 315/291 |
| 3,999,100 | 1/1977 | Dendy | 315/308 |
| 4,004,187 | 1/1977 | Walker | 315/205 |
| 4,004,188 | 1/1977 | Cooper | 315/261 |
| 4,016,451 | 4/1977 | Engel | 315/158 |
| 4,023,067 | 5/1977 | Zelina | 315/209 |
| 4,037,148 | 7/1977 | Owens | 323/17 |
| 4,039,897 | 8/1977 | Dragoset | 315/205 |
| 4,042,856 | 8/1977 | Steigerwald | 315/246 |
| 4,051,413 | 9/1977 | Abadie | 315/219 |
| 4,060,751 | 11/1977 | Anderson | 315/209 |
| 4,060,752 | 11/1977 | Walker | 315/244 |
| 4,066,930 | 1/1978 | Summa | 315/DIG. 5 |
| 4,072,878 | 2/1978 | Engel et al. | 315/205 |
| 4,074,170 | 2/1978 | Orban | 315/120 |
| 4,075,476 | 2/1978 | Pitel | 315/209 R |
| 4,087,702 | 5/1978 | Kirby | 307/252 |
| 4,100,462 | 7/1978 | McLellan | 315/179 |
| 4,121,136 | 10/1978 | Fournier | 315/205 |
| 4,127,789 | 11/1978 | Anderson | 315/209 |
| 4,127,795 | 11/1978 | Knoll | 315/210 |
| 4,145,636 | 3/1979 | Doi | 315/101 |
| 4,151,445 | 4/1979 | Davenport | 315/92 |
| 4,156,166 | 5/1979 | Shapiro | 315/209 |

(List continued on next page.)

*Primary Examiner*—Eugene R. LaRoche
*Attorney, Agent, or Firm*—Vaden, Eickenroht, Thompson & Boulware

[57] ABSTRACT

A high efficiency, electronic ballast is taught for high pressure sodium (HPS) lamps. The ballast is powered by AC line current which is rectified so that 160 volts of direct current lights the lamp. The ballast maintains constant wattage to the lamp and constant line wattage. A striker circuit develops a high voltage, short duration pulse to strike the lamp.

4 Claims, 4 Drawing Sheets

U.S. PATENT DOCUMENTS

| | | | |
|---|---|---|---|
| 4,162,429 | 7/1979 | Elms et al. | 315/284 |
| 4,163,923 | 8/1979 | Herbers | 315/209 |
| 4,170,747 | 10/1979 | Holmes | 315/307 |
| 4,188,660 | 2/1980 | Knoll | 363/49 |
| 4,199,710 | 4/1980 | Knoll | 315/307 |
| 4,204,141 | 5/1980 | Nuver | 315/205 |
| 4,206,385 | 6/1980 | Wisbey | 315/119 |
| 4,210,846 | 7/1980 | Capewell | 315/311 |
| 4,219,760 | 8/1980 | Ferro | 315/121 |
| 4,221,994 | 9/1980 | Friedman et al. | 315/224 |
| 4,232,252 | 11/1980 | Peil | 315/248 |
| 4,234,823 | 11/1980 | Charlot | 315/92 |
| 4,236,100 | 11/1980 | Nuver | 315/224 |
| 4,236,101 | 11/1980 | Luchaco | 315/158 |
| 4,237,403 | 12/1980 | Davis | 315/98 |
| 4,238,710 | 12/1980 | Nelson | 315/307 |
| 4,240,009 | 12/1980 | Paul | 315/224 |
| 4,241,295 | 12/1980 | Williams | 315/294 |
| 4,242,614 | 12/1980 | Vatis et al. | 315/153 |
| 4,245,177 | 1/1981 | Schmitz | 315/205 |
| 4,251,752 | 2/1981 | Stolz | 315/206 |
| 4,253,046 | 2/1981 | Gerhard | 315/224 |
| 4,258,295 | 3/1981 | Siglock | 315/189 |
| 4,259,614 | 3/1981 | Kohler | 315/219 |
| 4,266,165 | 5/1981 | Handler | 315/224 |
| 4,277,726 | 7/1981 | Burke | 315/98 |
| 4,277,728 | 7/1981 | Stevens | 315/307 |
| 4,286,195 | 8/1981 | Swines | 315/224 |
| 4,287,468 | 9/1981 | Sherman | 315/322 |
| 4,289,993 | 9/1981 | Harper et al. | 315/311 |
| 4,316,127 | 2/1982 | Lamoureux | 315/408 |
| 4,322,817 | 3/1982 | Kuster | 363/26 |
| 4,323,824 | 4/1982 | Roche | 315/289 |
| 4,346,331 | 8/1982 | Hoge | 315/158 |
| 4,348,615 | 9/1982 | Garrison et al. | 315/219 |
| 4,350,930 | 9/1982 | Peil et al. | 315/49 |
| 4,350,935 | 9/1982 | Spira et al. | 315/291 |
| 4,353,010 | 10/1982 | Knoll | 315/220 |
| 4,358,716 | 11/1982 | Cordes et al. | 315/306 |
| 4,368,406 | 1/1983 | Kruzich et al. | 315/158 |
| 4,370,600 | 1/1983 | Zansky | 315/244 |
| 4,370,601 | 1/1983 | Horii et al. | 315/307 |
| 4,373,146 | 2/1983 | Bonazoli et al. | 315/209 R |
| 4,378,513 | 3/1983 | Yoshikawa et al. | 315/176 |
| 4,378,514 | 3/1983 | Collins | 315/276 |
| 4,388,562 | 6/1983 | Josephson | 315/205 |
| 4,392,087 | 7/1983 | Zansky | 315/219 |
| 4,396,872 | 8/1983 | Nutter | 315/308 |
| 4,412,154 | 10/1983 | Klien | 315/224 |
| 4,412,156 | 10/1983 | Ota | 315/308 |
| 4,415,839 | 11/1983 | Lesea | 315/308 |
| 4,437,043 | 3/1984 | Pitel | 315/308 |
| 4,441,053 | 4/1984 | Daspit | 315/206 |
| 4,441,056 | 4/1984 | Siglock | 315/290 |
| 4,447,748 | 10/1984 | Grubbs | 315/306 |
| 4,464,606 | 8/1984 | Kane | 315/158 |
| 4,475,065 | 5/1984 | Bhalla et al. | 315/307 |
| 4,498,031 | 2/1985 | Stupp | 315/307 |
| 4,501,994 | 2/1985 | Spreadbury | 315/307 |
| 4,503,362 | 3/1985 | Hanlet | 315/221 |
| 4,503,363 | 3/1985 | Nilssen | 315/225 |
| 4,511,195 | 4/1985 | Barter | 315/308 |
| 4,513,227 | 4/1985 | Labadini et al. | 315/290 |
| 4,525,648 | 6/1985 | De Bijl | 315/224 |
| 4,525,650 | 6/1985 | Hicks et al. | 315/226 |
| 4,538,095 | 8/1985 | Nillsen | 315/244 |
| 4,563,616 | 1/1986 | Stevens | 315/220 |
| 4,585,974 | 4/1986 | Stupp | 315/307 |
| 4,604,552 | 8/1986 | Alley et al. | 315/176 |
| 4,609,849 | 9/1986 | French | 315/200 R |
| 4,609,850 | 9/1986 | Hanlet | 315/219 |
| 4,612,478 | 9/1986 | Payne | 315/176 |
| 4,612,479 | 9/1986 | Zansky | 315/194 |
| 4,613,792 | 9/1986 | Kroessler | 315/97 |
| 4,613,796 | 9/1986 | Bay | 315/219 |
| 4,614,898 | 9/1986 | Itani et al. | 315/224 |
| 4,631,449 | 12/1986 | Peters, Jr. | 315/205 |
| 4,631,450 | 12/1986 | Lagree et al. | 315/244 |
| 4,634,932 | 1/1987 | Nilssen | 315/119 |
| 4,636,691 | 1/1987 | De Man | 315/209 R |
| 4,641,061 | 2/1987 | Mumson | 315/210 |
| 4,644,227 | 2/1987 | Hammer et al. | 315/96 |
| 4,644,228 | 2/1987 | Nilssen | 315/242 |
| 4,647,817 | 3/1987 | Fahnrich et al. | 315/104 |
| 4,647,830 | 3/1987 | Bees | 320/1 |
| 4,651,060 | 3/1987 | Clark | 315/199 |
| 4,652,797 | 3/1987 | Nilssen | 315/209 R |
| 4,663,566 | 5/1987 | Nagano | 315/97 |
| 4,682,084 | 7/1987 | Kuhnel et al. | 315/307 |

FOREIGN PATENT DOCUMENTS

| | | |
|---|---|---|
| 3214669 | 10/1983 | Fed. Rep. of Germany . |
| 3236703 | 5/1984 | Fed. Rep. of Germany . |
| 1277677 | 10/1961 | France . |
| WO8201276 | 4/1982 | PCT Int'l Appl. . |
| WO8301313 | 4/1983 | PCT Int'l Appl. . |
| 2117192 | 5/1983 | United Kingdom . |

BALLAST FOR HIGH PRESSURE SODIUM LAMPS HAVING CONSTANT LINE AND LAMP WATTAGE

FIELD OF THE INVENTION:

This invention relates to the field of electronic solid state ballasts for high-intensity discharge lamps. More particularly, it relates to solid state ballasts for high pressure sodium lamps.

BACKGROUND OF THE INVENTION:

In high-intensity discharge lamps, light is generated when an electric current is passed through a gaseous medium. The lamps have variable resistance characteristics that require operation in conjunction with a ballast to provide appropriate voltage and current limiting means. Control of the voltage, frequency, and current supply to the lamps is necessary for proper operation and determines the efficiency of the lamps. In particular, it determines the size and weight of the required ballast.

The appropriate voltage, frequency and current for efficient running of a lamp in its normal operating state is not appropriate for the lamp during its warm-up state. A high-intensity lamp typically takes several minutes to warm up from the time it is struck or turned on to its normal operating state. Initially, the lamp is an open circuit. Short pulses of current are sufficient to strike the lamp, provided they are of adequate voltage. Subsequent to striking, the lamp's resistance drops radically. The resistance then slowly rises during warm-up to its normal operating level. Hence, subsequent to striking and during warm-up the current of the lamp must be limited to prevent internal lamp damage.

Ballasts for high pressure sodium (HPS) lamps must be somewhat different from ballasts for other types of high intensity discharge lamps. First, the voltage required to strike a HPS lamp is much greater than that needed for other types of lamps. A short duration voltage pulse of over 2000 volts is needed for lower-wattage HPS lamps, and about 3000 volts is needed for 1000 watt HPS lamps. The need for a high voltage striking pulse typically requires a special starting circuit.

Second, it is a characteristic of a HPS lamp that its lamp voltage increases over the life of the lamp due to the slow increase in the stabilized temperature of its arc tube. Unless the HPS ballast maintains the lamp wattage, the HPS lamp output will vary beyond acceptable limits.

SUMMARY OF THE INVENTION:

An electronic ballast is taught for 55 volt, pressure sodium (HPS) lamps in wattages of 35 W to 250 W and higher.

The ballast is powered by 115 volts, 50–60 hertz, alternating current. The input alternating current is rectified so that 160 V of DC current powers the lamp. The ballast maintains constant wattage to the lamp by using a known, reference lamp voltage at a specified current and a current integration feedback loop, which monitors the lamp current and varies the time period of the DC current pulse to the lamp.

The ballast has a striker circuit that uses a high voltage induction coil to develop a 2300 volt, 1 microsecond pulse to strike the sodium lamp.

The ballast according to the present invention maintains a constant line wattage by maintaining constant wattage in the lamp and by using a circuit configuration that yields a ballast efficiency (power out/power in) of greater than 90%. That is, the power dissipated by the ballast is less than 10% of the input power.

Line voltage variations of ±10% result in lamp wattage variations of only ±1.0%, and line wattage variations of less than ±1.0%.

Prior art wire iron constant wattage ballasts typically have ±5% line wattage variations when the line voltage varies by ±10%. Therefore, it is apparent that the present invention achieves line wattage variations which are much less than such prior art devices.

The present invention also maintains a constant lamp wattage by maintaining a constant, regulated current in the lamp circuit. The lamp circuit current is regulated by the current feedback loop as described herein. The voltage across the lamp is constant at the regulated current, resulting in a constant lamp wattage.

The ballast also has an undervoltage protection circuit, a voltage spike protector, and a radio frequency interference (RFI) filter.

Since the ballast provides very pure direct current to the lamp, the lamp does not have the strobe effect typical of lamps powered by alternating current. This makes the present invention particularly suitable for lighting of sporting events and work areas having fast moving equipment.

It is a feature of the present invention to provide an AC line-powered ballast for HPS lamps whereby line wattage is kept constant without use of special circuitry.

It is another feature of the present invention to precisely regulate the input signal to the ballast by using a RFI filter and undervoltage and voltage spike protection circuits.

It is another feature of the present invention that the high voltage striker circuit is only active when both the ambient light is below a reference value and the lamp is not lit. Further, the striker circuit operates on a predetermined on/off time cycle.

These and other features of the present invention will be apparent to one skilled in the art from the drawings and the detailed description.

Figure 1:
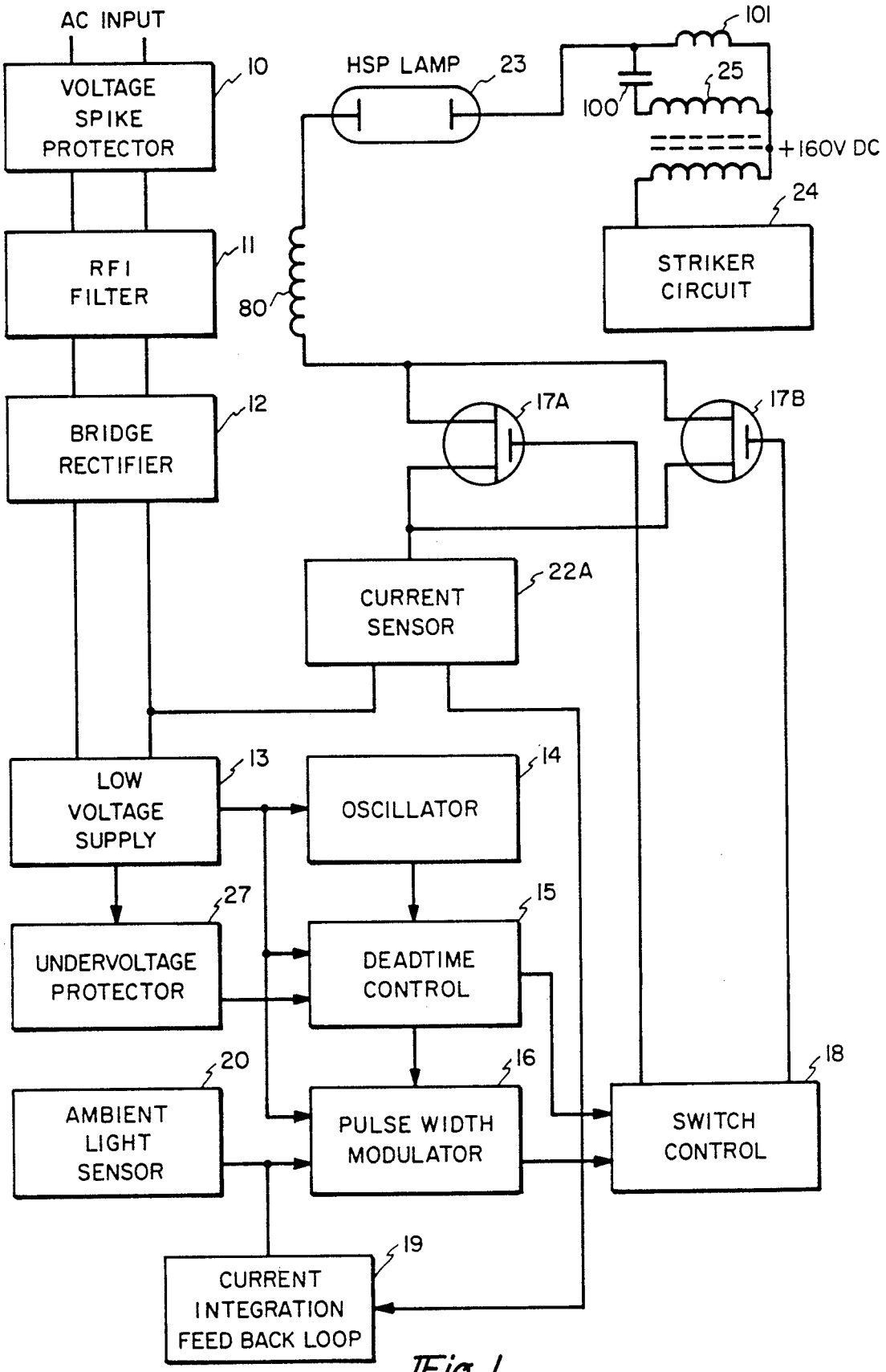
FIG. 1 is a block diagram illustrating the control sequences of a preferred embodiment of the present invention.

DETAILED DESCRIPTION:

FIG. 1 illustrates in a schematic block diagram fashion the elements of a preferred embodiment of the ballast.

The scheme assumes an input of alternating current, preferably 115 VAC.

A spike protector 10 prevents intermittent high voltages or spikes from reaching the ballast. Also, the ballast contains a radio frequency interference (RFI) filter 11 to prevent RFI signals generated by the ballast from being picked up on the power line. RFI filter 11 is comprised of capacitors 55, 56 and 57, and inductors 82 and 83. See FIG. 2A.

Bridge rectifier 12, in combination with capacitor 58, then rectifies the alternating current in a traditional fashion into direct current waves of 160 VDC.

Low voltage power supply 13, fed by input from rectifier 12, supplies 15 volts of direct current to oscillator 14, dead time controller 15, and pulse width modulator 16. Low voltage supply 13 is comprised of resistor 88, capacitor 59, and 15 volt zener diode 66. See FIG. 2A.

Undervoltage protector 27 shuts off current to lamp 23 in the event that the input line voltage drops below a safe limit.

Referring again to FIG. 1, oscillator 14, dead time controller 15, and pulse width modulator 16, together with switch control 18 form the means for driving hexfet switches 17A and 17B.

The ballast also contains a 5 VDC reference power supply 54 internal to subcircuit 52. See FIG. 3.

The frequency of oscillator 14 determines the frequency of the direct current pulses in the lamp circuit. The high frequency wave formed by oscillator 14 is supplied to dead time controller 15 and pulse width modulator 16. Pulse width modulator 16 is also supplied with input from a current integration feedback loop 19 and from ambient light sensor 20. Based upon the current sensed by current sensor 22A, current integration feedback loop 19 determines whether the current to hexfets 17A and 17B exceeds a reference value. If so, loop 19 sends a signal to pulse width modulator 16 causing it to vary its output signal accordingly.

Ambient light sensor 20 senses the amount of light present in the surroundings and sends a signal to pulse width modulator 16, causing it to output a zero pulse if the sensed amount of ambient light is greater than a fixed value. This turns off lamp 23. Ambient light sensor 20 does not affect the output of pulse width modulator 16 if the ambient light is greater than the fixed value.

When ambient light sensor 20 detects that the ambient light is below the fixed value, dead time controller 15 produces a modulated output signal that corresponds to a maximum duty cycle of slightly less than 100 percent. Dead time controller 15 provides a dead time between the direct current waves.

Switch control 18 combines the outputs of dead time controller 15 and pulse width modulator 16, and sends the wave forms to hexfets 17A and 17B.

Switch control 18 also controls the time period at which hexfets 17A and 17B are switched on and off. This frequency corresponds to the frequency of oscillator 14.

Due to the nature of HPS lamp 23, it is necessary to include a striker circuit 24 which, in combination with high voltage induction coil 25, outputs a high voltage, short duration pulse sufficient to strike HPS lamp 23. In a preferred embodiment, striker circuit 24 and coil 25 output a 2300 volt 1 microsecond pulse for a 150 watt ballast.

Figure 2A:
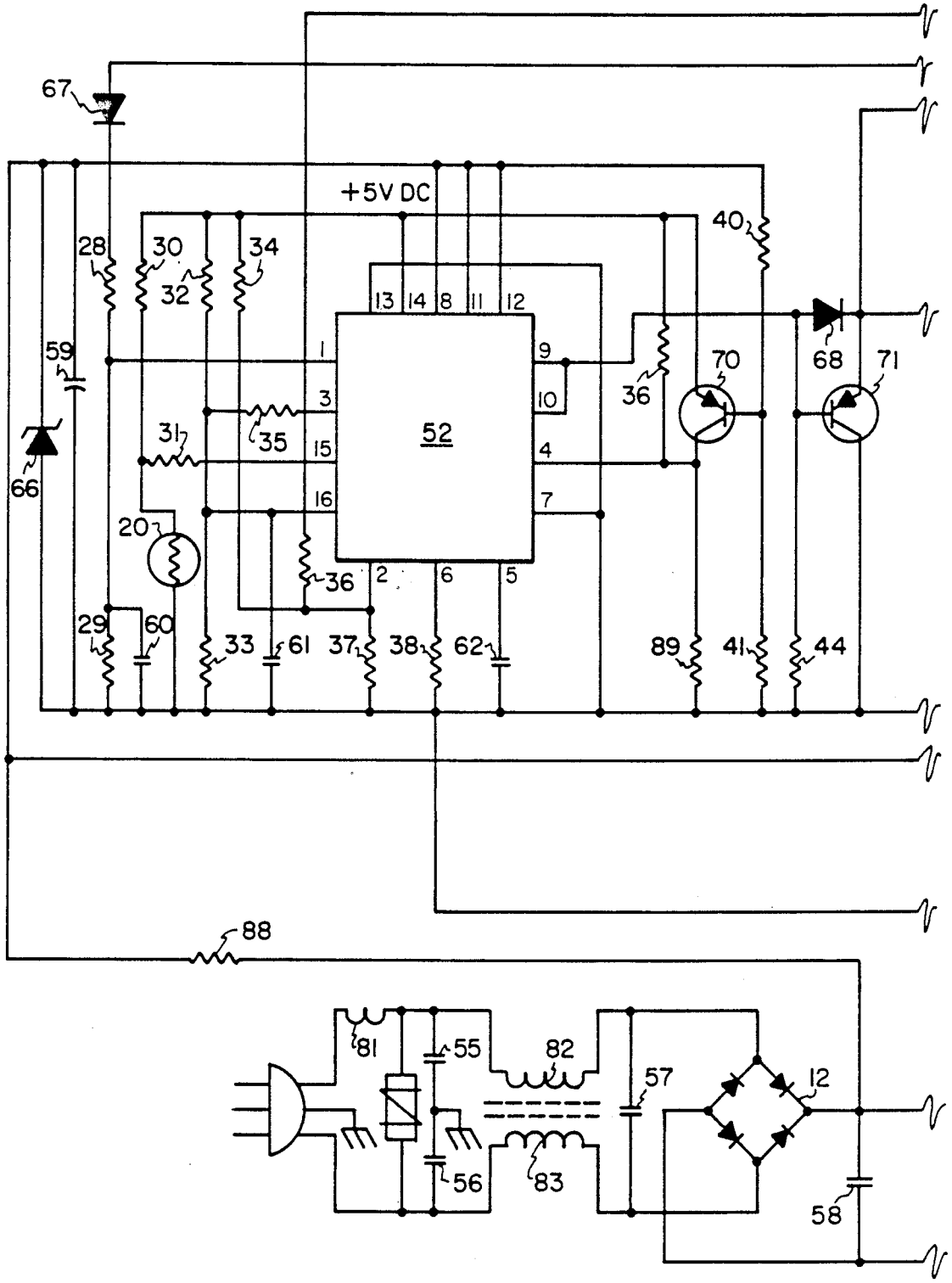
FIGS. 2A and 2B are circuit diagrams of a preferred embodiment of the present invention.
Figure 2B:
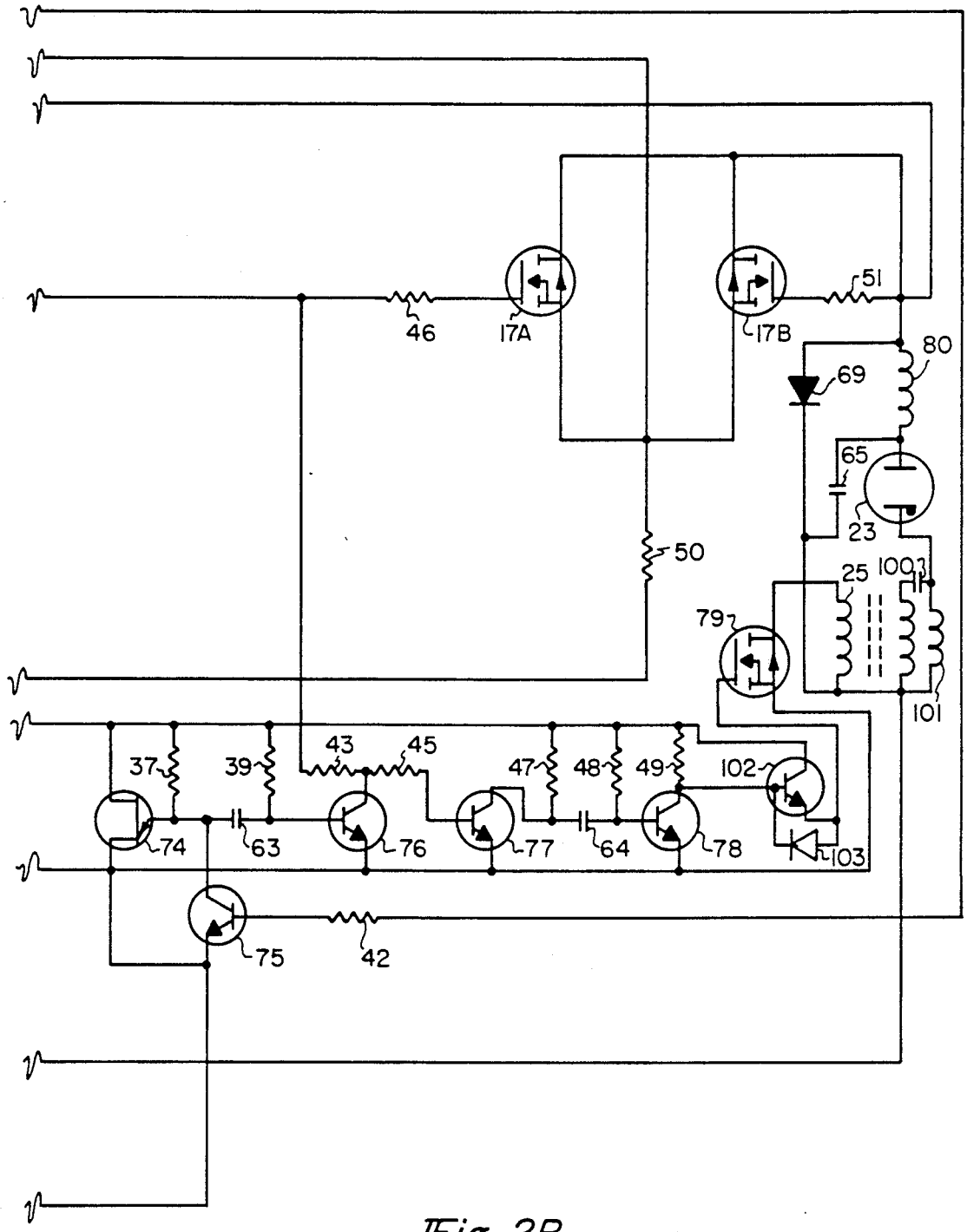
Figure 3:
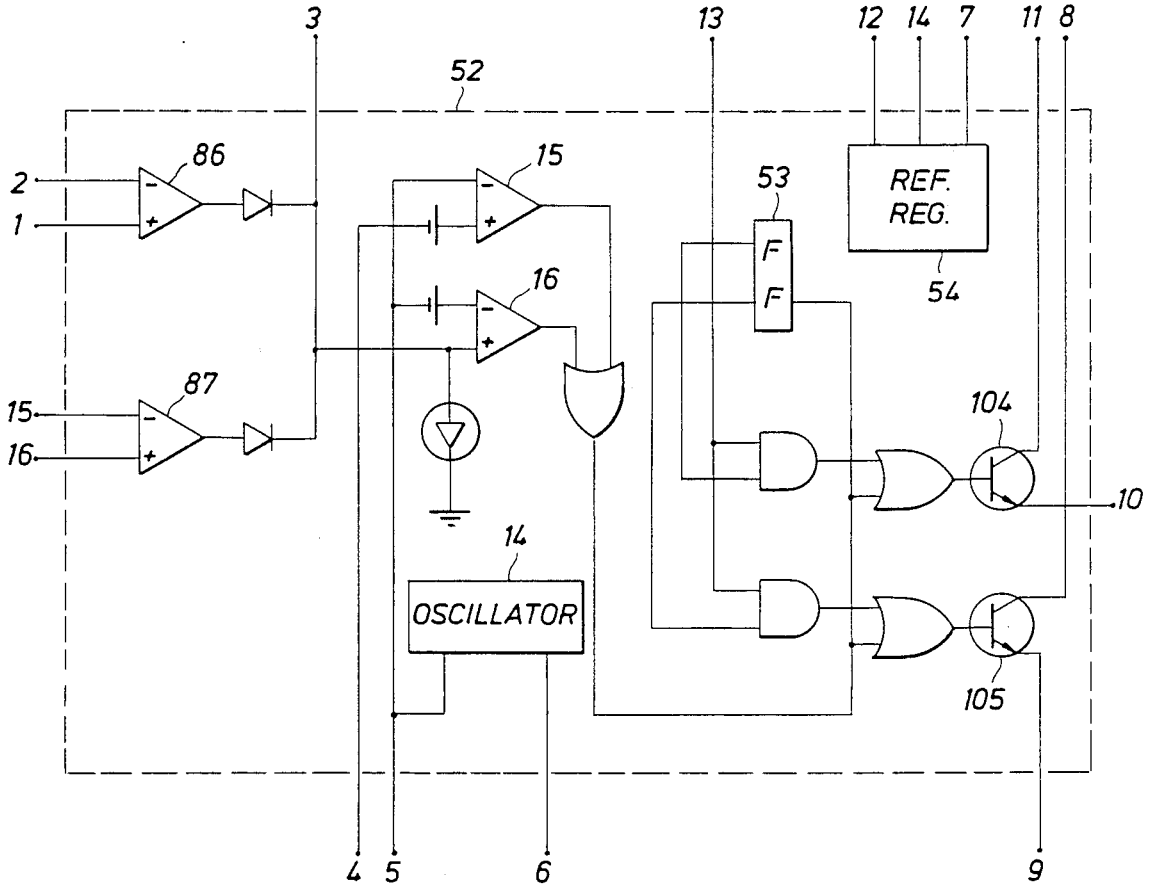
FIG. 3 is a block diagram of pulse width modulation subcircuit 52.

FIGS. 2A and 2B represent a more detailed diagram for the preferred embodiment of the ballast depicted in FIG. 1. As shown in FIG. 2A, the ballast utilizes a pulse width control subcircuit 52. One suitable, commercially available IC chip is a Motorola TL 494. Use of the TL 494 is convenient but not necessary. FIG. 3 is a block diagram of subcircuit 52, using a TL 494 IC chip. As shown by FIG. 3, subcircuit 52 includes the following components:

1. Pulse width modulator 16;
2. On chip oscillator 14;
3. Two user available operational amplifiers, error amplifiers 86 and 87;
4. An internal 5 VDC reference power supply 54;
5. Variable dead time controller 15.

Flip-flop 53 depicted in FIG. 3 is disabled by grounding pin 13 (FIG. 2A). This permits the TL 494 to be used for the single-ended operation mode (i.e., as opposed to its push-pull operating mode) to drive the single output-drive switching hexfet. Referring to FIG. 2A, the grounding of pin 13 of subcircuit 52 causes the output pulse train of the two output transistors 104 and 105 to operate in parallel.

The frequency of oscillator 14 is controlled by resistor 38 and capacitor 62. Oscillator 14 develops a frequency equal to $$\frac{1.1}{RC}$$

which, in a preferred embodiment, equals 72 kilocycles per second. This frequency corresponds to a repetitive period of 13.88 microseconds.

The output at pins 9 and 10 of subcircuit 52 is 15. VDC. The collectors of output transistors 104 and 105 are connected to the 15 VDC power supply. The emitter of transistors 104 and 105 develops a 15 VDC signal at pins 9 and 10 of subcircuit 52. The period of this signal corresponds to 95% of the repetitive period of oscillator 14. Dead time controller 15 limits the maximum period of the +15 VDC signal at pins 9 and 10 to 52% of the repetitive period of oscillator 14, or 7.2 microseconds. Error amplifiers 86 and 87 (See FIG. 3) are used to control the maximum pulse width of this 7.2 microsecond signal.

Error amplifier 87 operates as a Schmitt trigger and performs the function of an on/off switch. Its output voltage is a function of the input from a voltage divider containing ambient light sensor 20. Error amplifier 87 turns pulse width modulator 16 to an "off" state when ambient light sensor 20 senses that it is not dark outside. Error amplifier 87 does not affect the output of pulse width modulator 16 at all when it is dark outside.

A current integration feedback loop 19 is used to control the current to the lamp. Feedback loop 19 operates in the following manner. Error amplifier 86 senses the voltage developed across resistor 50. Referring to FIGS. 2A and 3, this voltage is integrated by means of resistors 28 and 29, diode 67, and capacitor 60. The junction of resistors 28 and 29 is connected to the + input of error amplifier 86. The − input of error amplifier 86 is connected to the voltage developed across resistor 37, which is the reference voltage. This reference voltage is used to set the root-mean-square (RMS) current in the lamp circuit. Error amplifier 86 controls the period of the 7.2 microsecond pulse from zero to 7.2 microseconds, thereby controlling the current flowing in the lamp circuit.

The +15 VDC signal at pins 9 and 10 of subcircuit 52 is also used to drive the gates of hexfet switches 17A and 17B, causing them to go into conduction. See FIG. 2B. When the signal at pin 9 is reduced to zero, output transistor 71 conducts, thereby discharging the internal gate capacitances of hexfets 17A and 17B. This configuration generates turn-off times for hexfets 17A and 17B of 100 nanoseconds or less, resulting in minimum switching power dissipation by hexfets 17A and 17B.

As stated above, ballasts for high pressure sodium lamps require a special striker circuit to strike the lamp.

Striker circuit 24 of the present invention operates in the following manner. Referring to FIG. 2B, unijunction transistor 74 and transistor 76 comprise a relaxation oscillator, where capacitor 63 charges through resistor 37 until the firing voltage of transistor 74 is reached. When transistor 74 conducts, it discharges capacitor 63. This causes the base of transistor 76 to go negative, thereby turning it off. The period of the relaxation oscillator is approximately 6 seconds. The off time of transistor 76 is 50 milliseconds. Transistor 75 is normally on, thereby stopping the relaxation oscillator.

Transistor 75 starts the relaxation oscillator when pin 3 of subcircuit 52 is zero volts. Pin 3 is only zero volts when the sky is dark and lamp 23 is not conducting. When pin 3 goes to zero volts, transistor 75 goes out of conduction, thereby starting the 6 second relaxation oscillator.

Transistor 77 gets an input signal from pins 9 and 10 of subcircuit 52. This circuit is shorted to common by transistor 76, which turns off for 50 milliseconds for every 6 second period of the relaxation oscillator.

When transistor 76 goes off, transistor 77 turns on. This turns off transistor 78 for 2.5 microseconds, as controlled by the following time constant:

$$\text{Time Constant} = C \times R \times .693$$

where

C is the value of capacitor 64

R is the value of resistor 48

The turning off of transistor 78 and the action of emitter follower 102 causes hexfet 79 to turn on, putting high current in the primary winding of high voltage induction coil 25. When hexfet 79 turns off, the magnetic field in the primary winding of coil 25 collapses, causing the rapid development of greater than 2000 volts (negative) coupled through capacitor 100 on the high voltage side of lamp 23. Inductor 101 decouples the high voltage pulse from the power supply. This causes lamp 23 to strike. This striking pulse occurs while hexfets 17A and 17B are conducting, thereby keeping lamp 23 in conduction.

When the current in the lamp circuit increases, pin 3 of subcircuit 52 goes to positive 2.5 volts, causing the 6 second relaxation oscillator to stop.

Current to lamp 23 is provided by the lamp circuit by use of a step down converter or down switcher as discussed below. When lamp 23 is not conducting, capacitor 65 charges to 160 volts. After lamp 23 is struck as discussed above, it goes into conduction.

Hexfets 17A and 17B are used to switch 160 VDC across inductor 80 and lamp 23 in repetitive cycles. Although the use of hexfet switches is discussed, it will be apparent to those skilled in the art that other types of switches may be suitable. These repetitive cycles result in a linear ramp current in inductor 80 that reaches a known peak valve which depends upon the lamp manufacturer's recommended magnitude. Error amplifier 86 (FIG. 3) senses whether the peak current has been reached. If it has been reached, error amplifier 86 causes pins 9 and 10 of subcircuit 52 to go to zero, which drives hexfets 17A and 17B out of conduction. Thus, the regulated current to lamp 23 is kept constant, so that the bulb wattage is also constant. This regulated current does not change if the line voltage varies from 100 to 120 VAC.

When hexfets 17A and 17B go out of conduction, the magnetic field that was created in inductor 80 collapses, causing the anode of diode 69 to go positive. This discharges inductor 80 through capacitor 65 and lamp 23.

Since inductor 80 is now discharged, it is ready to receive more current. Capacitor 65 filters the voltage across lamp 23 and also provides inductor 80 with a return path if lamp 23 goes out of conduction.

The ballast of the present invention also has an undervoltage protector 27. The purpose of undervoltage protector 27 is to prevent damage to hexfets 17A and 17B in the event that the input line voltage drops to a point where the output of low voltage power supply 13 would also drop. At that point, the voltage to the gates of hexfets 17A and 17B would be reduced when they are under a full current load, resulting in such increased power dissipation by hexfets 17A and 17B as to possibly destroy them.

Undervoltage protector 27 operates as follows. Referring to FIG. 2A, when the voltage across zener diode 66 drops to a dangerously low level, transistor 70 conducts This brings pin 4 of subcircuit 52 to +5 volts, which, by dead time control, reduces the repetitive period of the lamp's duty cycle to zero. This cuts off all current to lamp 23. The hot sodium lamp cannot relight at this point due to "sodium dip"; that is, the sodium lamp's striking voltage is then greater then the voltage that the circuit is able to supply.

The ballast described herein is able to achieve efficiencies of greater than 90%. At the same time, the input line wattage remains constant to within ±2.5%, even though the line voltage varies by ±10%.

The following example illustrates typical values that may be achieved by the present invention:

EXAMPLE

Ballast Rating - 70 watts
Input Power (optimal) - 78 watts
Lamp Power (optimal) - 70 watts

| Line Input Voltage | Line Wattage | Lamp Wattage | Ballast Efficiency % | Ballast Wattage | % Deviation of Input Line Watts | % Deviation of Lamp Wattage |
|---|---|---|---|---|---|---|
| 110 VAC | 78.2 | 70.85 | 90.6 | 7.35 | 0 | 0 |
| 120 VAC | 79 | 71.79 | 90.8 | 7.21 | +1.02 | +1.32 |
| 100 VAC | 78.3 | 70.54 | 90.0 | 7.76 | +0.127 | −0.437 |

Several elements or features of the present invention contribute to its high efficiency. These include the following:

A. The use of a step down or buck converter circuit to apply power to the lamp. A step down converter, like that used in the present invention, requires much less current to power the lamp. For example, when the present invention is used to power a 70 watt, 55 volt HPS lamp, the average current drawn from the power supply is only about 35% of the current through the lamp. It is thus apparent that the use of a step down converter results in a higher ballast efficiency.

The particular elements of the step down converter circuit that contribute to its efficiency include the use of:

(1) One magnetic element or inductor 80;

(2) A single switching element, which may be wired in parallel for higher current capability;

(3) Current integration feedback loop 19 to regulate the current in the lamp circuit;

(4) A diode 69 connected from the output of hexfet switches 17A and 17B to the power supply;

(5) A capacitor 65 across the load, lamp 23;

(6) An operating frequency in the range of 65 to 75 kilocycles per second.

B. The use of hexfet or mosfet switches to switch current through the lamp. Such switches require very small amounts of power to turn them on and off. Bipolar switching devices would have difficulty achieving an efficiency similar to that of a hexfet or mosfet switch.

C. The use of a drum core inductor 80 having multiple strands of Litz wire for increased efficiency.

D. The use of an integrated circuit for pulse width control subcircuit 52. The integrated circuit requires very little power.

E. The use of a switching element whose total on time is less than 40% when operated with a 160 VDC power supply. The two switches used in a typical push-pull electronic ballast each have an on time of slightly less than 50%, for a total on time of nearly 100%.

F. The peak current in the hexfet switches 17A and B and in inductor 80 is about two times the average current through the lamp.

What is claimed is:

1. A constant line and lamp wattage ballast for high pressure sodium lamps, comprising:

a direct current source that generates pulses of direct current;

a lamp circuit, having a voltage, that is interconnected with, and receives direct current pulses from, said direct current source, said lamp circuit including, a high pressure sodium lamp, and an inductor interconnected with said lamp;

ambient light sensing means for sensing the magnitude of ambient light present near said lamp;

a striker circuit interconnected with a high voltage induction coil, said striker circuit being adapted to generate a high voltage signal to strike said lamp when both the magnitude of the ambient light sensed by said ambient light sensing means is below a predetermined value and said lamp is not lit;

an undervoltage protector means for sensing the lamp circuit voltage, comparing it with a predetermined value, and extinguishing power to said lamp if the circuit voltage is less than the predetermined value;

a current feedback means for sensing the current present in the said lamp circuit, comparing said current with a reference value, and generating an output signal;

a pulse width modulator that, in response to said output signal of said current feedback means, varies the width of said direct current pulses;

a high frequency oscillator;

a switch that gates direct current pulses to said lamp; and a switch control means, responsive to said oscillator, for controlling said switch and thereby controlling the frequency of said direct current pulses that power said lamp.

2. The ballast of claim 1, further comprising:

a dead time controller having an output signal that causes said pulses width modulator to vary the width of said direct current pulses by a fixed value.

3. The ballast of claim 1, wherein said direct current source comprises:

an alternating current source; and means for rectifying the current from said alternating current source into pulses of direct current.

4. The ballast of claim 1, wherein the frequency of said high frequency oscillator is in the range of about 60 to 80 kilocycles per second.

* * * * *